US007042428B2

(12) United States Patent
Park

(10) Patent No.: US 7,042,428 B2
(45) Date of Patent: May 9, 2006

(54) APPARATUS AND METHOD FOR PREVENTING LOCK-UP OF LCD IN MOBILE TERMINAL

(75) Inventor: Jong-Boo Park, Seoul (KR)

(73) Assignee: LG Electronics Inc., Seoul (KR)

( * ) Notice: Subject to any disclaimer, the term of this patent is extended or adjusted under 35 U.S.C. 154(b) by 282 days.

(21) Appl. No.: 10/265,319

(22) Filed: Oct. 7, 2002

(65) Prior Publication Data

US 2003/0071767 A1 Apr. 17, 2003

(30) Foreign Application Priority Data

Oct. 15, 2001 (KR) ..... 2001-0063350

(51) Int. Cl.
*G09G 3/36* (2006.01)

(52) U.S. Cl. ..... 345/87; 345/92; 345/418

(58) Field of Classification Search ..... 345/84, 345/87, 92, 93, 419, 418
See application file for complete search history.

(56) References Cited

U.S. PATENT DOCUMENTS 5,986,629 A * 11/1999 Smith et al. ..... 345/84
6,563,319 B1 * 5/2003 Kraz ..... 324/458
6,658,597 B1 * 12/2003 Ker et al. ..... 714/23
6,690,433 B1 * 2/2004 Yoo et al. ..... 349/40
6,700,385 B1 * 3/2004 Kraz ..... 324/457
6,753,836 B1 * 6/2004 Kwon ..... 345/87

FOREIGN PATENT DOCUMENTS

| | | |
|---|---|---|
| JP | 02-108021 | 4/1990 |
| JP | 02-130588 | 5/1990 |
| JP | 04-058219 | 2/1992 |
| JP | 57-98491 | 12/1995 |
| JP | 08-050274 | 2/1996 |

OTHER PUBLICATIONS

Japanese Office Action dated Aug. 26, 2005, pp. 1-3, 2002-262171.

* cited by examiner

*Primary Examiner*—Phu K. Nguyen
(74) *Attorney, Agent, or Firm*—Fleshner & Kim LLP

(57) ABSTRACT

An apparatus and method for preventing lock-up of an LCD it is provided, in which a voltage on a pin of the LCD is monitored, it is determined whether an electrostatic discharge (ESD) has been applied to the LCD based on the monitored voltage, and the LCD is reset if an ESD has been applied to the LCD. In a preferred embodiment, the LCD pin whose voltage is monitored exhibits a voltage level change, in response to an ESD, that is greater than a voltage level change exhibited by all other individual pins of the LCD. Because the LCD is reset only when an ESD condition has been detected, periodic blinking of the LCD is prevented.

19 Claims, 3 Drawing Sheets

APPARATUS AND METHOD FOR PREVENTING LOCK-UP OF LCD IN MOBILE TERMINAL

BACKGROUND OF THE INVENTION

1. Field of the Invention

The present invention relates to a mobile terminal, and more particularly, to an apparatus and method for preventing lock-up of an LCD in a mobile terminal.

2. Background of the Related Art

In general, a liquid crystal display (LCD) is a device that utilizes an optical switching phenomenon. Specifically, liquid crystal, an intermediate between a solid and a liquid, is injected between two thin glass plates and the arrangement of the liquid crystal molecules can be changed by creating a voltage difference between electrodes on the upper and lower glass plates. In this way, the liquid crystal molecules can be rearranged to manipulate the polarization of input light, which in turn can be used to provide light and dark areas on a pixel-by-pixel basis in order to display a number or an image.

Once used for watches or electronic computers in the 1970's, the LCD's scope of use has since been extended and is now a core display device used for advanced information devices and image displayers.

Because LCDs are thin, light and exhibit low power consumption, they are suitable for portable information terminals, such as notebook computers (laptop computers) and mobile phones. The relative importance of LCDs for mobile phone applications is rising, and thus larger and more complicated LCDs are being made.

However, as LCDs become larger and more complicated, they become more susceptible to electrostatic discharge (ESD). Thus, a method for operating the LCD in a normal manner when it is locked up by the ESD of the mobile terminal is needed.

Related art methods for preventing lock-up of an LCD of a mobile terminal include a hardware method, in which a transient voltage suppression (TVS) diode, for preventing static electricity from being introduced, is installed at lines connected to each input pin of the LCD of a mobile terminal. Another related art method is a software method, in which the LCD is periodically reset by software.

FIG. 1 is a drawing illustrating an example of an apparatus for preventing lock-up of an LCD in a mobile phone, in accordance with the related art. As shown in FIG. 1, the related art apparatus for preventing lock-up of an LCD in a mobile phone includes: an LCD 10 for displaying an image; a baseband chip set 20 for controlling a display operation of the LCD 10; and first through sixth TVS diodes (TVS1–TVS6) for limiting each voltage input to the LCD 10.

The first TVS diode TVS1 limits a voltage input so as to be boosted in the LCD 10 and a brightness control voltage. The second TVS diode TVS2 limits a level of a data input from the baseband chip set 20 to the LCD 10. The third TVS diode TVS3 limits a level of a clock input from the baseband chip set 20 to the LCD 10. The fourth TVS diode TVS4 limits a level of an address input from the baseband chip set 20 to the LCD 10. The fifth TVS diode TVS5 limits a level of a chip select signal input from the baseband chip set 20 to the LCD 10. The sixth TVS diode TVS6 limits a level of a reset signal input from the baseband chip set 20 to the LCD 10.

In this manner, the related art LCD lock-up preventing apparatus using TVS diodes in the mobile terminal limits the voltage input to each pin of the LCD 10, thereby preventing the LCD 10 from being locked up due to the ESD. However, the related art LCD lock-up preventing apparatus that utilizes TVS diodes in the mobile terminal has disadvantages in that, since a TVS diode needs to be provided for every line input to each pin of the LCD, the size of the LCD is increased, which makes this approach unsuitable for mobile terminals, which are typically compact in size.

The software method for periodically resetting the LCD in order to prevent lock-up of the LCD causes inconvenience for users, as the LCD is periodically reset and thus blinks periodically.

The above references are incorporated by reference herein where appropriate for teachings of additional or alternative details, features and/or technical background.

SUMMARY OF THE INVENTION

An object of the invention is to solve at least the above problems and/or disadvantages and to provide at least the advantages described hereinafter.

An object of the present invention is to provide an apparatus and method for preventing lock-up of an LCD in a mobile terminal that is capable of detecting whether an ESD has been applied to an LCD by detecting a voltage on a predetermined pin of the LCD.

Another object of the present invention is to provide an apparatus and method for preventing lock-up of an LCD in a mobile terminal that are capable of preventing lock-up of an LCD due to an ESD by monitoring a voltage input to a pin that exhibits the greatest voltage level change, when an ESD is applied to the LCD, than all other individual pins of the LCD, checking whether the LCD is in a normal state based on the monitored voltage, and resetting the LCD if the LCD is not in a normal state.

To achieve at least the above objects, in whole or in part, there is provided an apparatus for preventing lock-up of a liquid crystal display (LCD), including an LCD, an electrostatic discharge (ESD) detecting unit for detecting whether an ESD has been applied to the LCD, and a baseband chip set for resetting the LCD according to a reset control signal output from the ESD detecting unit.

To achieve at least these advantages, in whole or in part, there is further provided an apparatus for preventing lock-up of an LCD, including an LCD, an analog-digital converter for converting an analog voltage input to a predetermined pin of the LCD into digital voltage, wherein, when ESD is applied to the LCD, the predetermined pin exhibits a voltage level change that is greater than a voltage level change exhibited by all other individual pins of the LCD, a decision logic for determining whether an ESD has been applied to the LCD, by checking whether the digital voltage is within a predetermined range in which the LCD is in a normal state, and a baseband chip set for resetting the LCD under the control of the decision logic.

To achieve at least these advantages in whole or in part, there is further provided a method for preventing lock-up of an LCD, including converting an analog voltage of a predetermined pin of the LCD into a digital voltage, checking whether an LSD has been applied to the LCD based on the digital voltage, and resetting the LCD if an ESD has been applied to the LCD.

To achieve at least these advantages, in whole or in part, there is further provided a method for preventing lock-up of an LCD, including monitoring a voltage on a pin of the LCD, determining if an LSD has been applied to the LCD based on the monitored voltage, and resetting the LCD if an ESD has been applied to the LCD.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein:

FIG. 2 1s a schematic diagram of an apparatus for preventing lock-up of an LCD in a mobile terminal, in accordance with one preferred embodiment of the present invention;

DETAILED DESCRIPTION OF PREFERRED EMBODIMENTS

Figure 1:
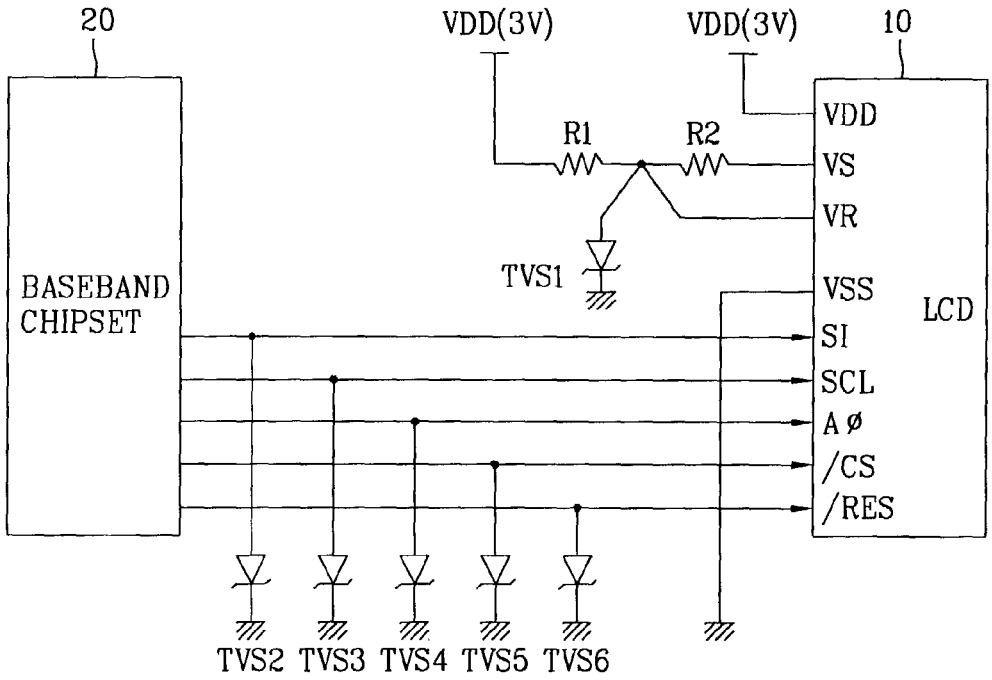
FIG. 1 BACKGROUND ART
FIG. 1 is a schematic diagram of an apparatus for preventing lock-up of an LCD in a mobile terminal, in accordance with the related art.
Figure 2:
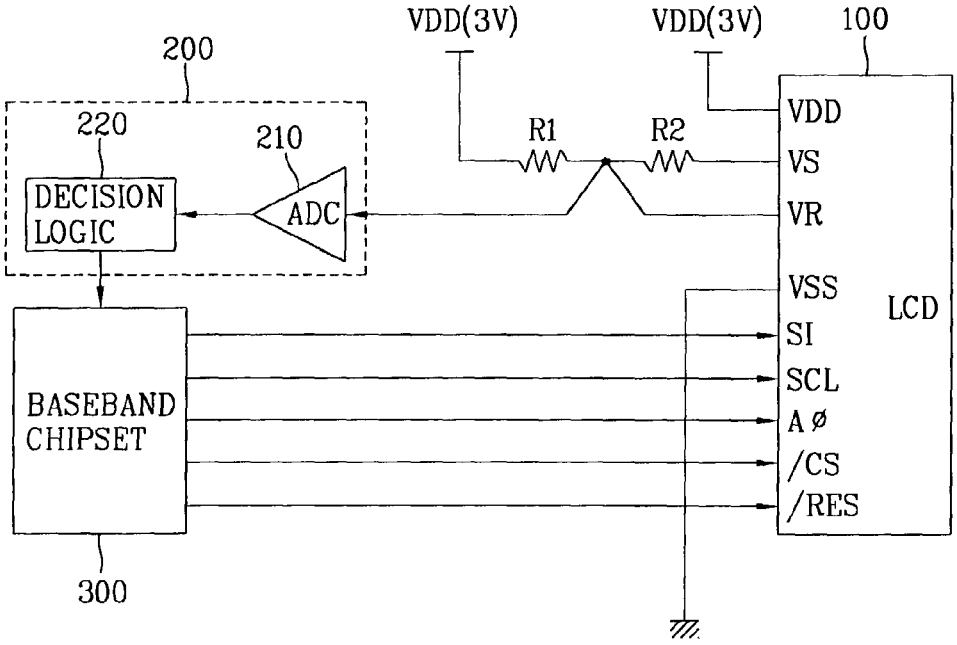

FIG. 2 is a schematic diagram of an apparatus for preventing lock-up of an LCD in a mobile terminal, in accordance with one preferred embodiment of the present invention.

As shown in FIG. 2, an apparatus for preventing lock-up of an LCD in a mobile terminal includes: an LCD 100 for displaying an image; an ESD detecting unit 200 for detecting whether an ESD has been applied to the LCD 100 by sensing a voltage input to a specific pin of the LCD 100; and a baseband chip set 300 for resetting the LCD 100 according to a reset control signal output from the ESD detecting unit 200.

The ESD detecting unit 200 includes: an analog-digital converter 210 for converting an analog voltage input to a specific pin of the LCD 100 into a digital voltage; and a decision logic 220 for determining whether an ESD has been applied to the LCD 100, by checking whether the digital voltage output from the analog-digital converter 210 is within a predetermined range.

The specific pin of the LCD 100 which is monitored by the ESD detecting unit 200 is preferably a pin that exhibits the greatest voltage level change when ESD occurs, and the predetermined voltage range is preferably a voltage level range that the specific pin can have when the LCD 100 is in a normal state with no ESD applied thereto. However, the voltage at other pins of the LCD 100 can be monitored to determine whether ESD has been applied, while still falling within the scope of the present invention.

The operation of the apparatus for preventing lock-up of an LCD in a mobile terminal, constructed as described above in accordance with one preferred embodiment of the present invention, will now be explained with reference to FIGS. 3A and 3B.

Figure 3A:
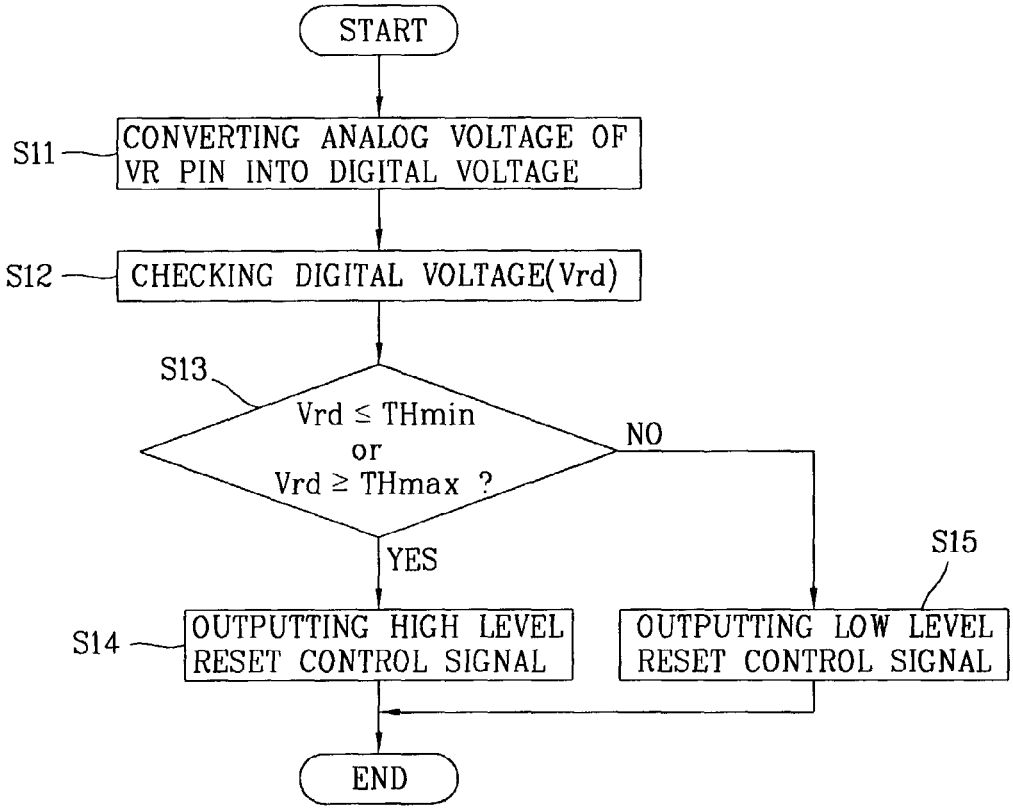
FIG. 3A is a flowchart of control routine used by the ESD detecting unit of FIG. 1, in accordance with one preferred embodiment of the present invention.
Figure 3B:
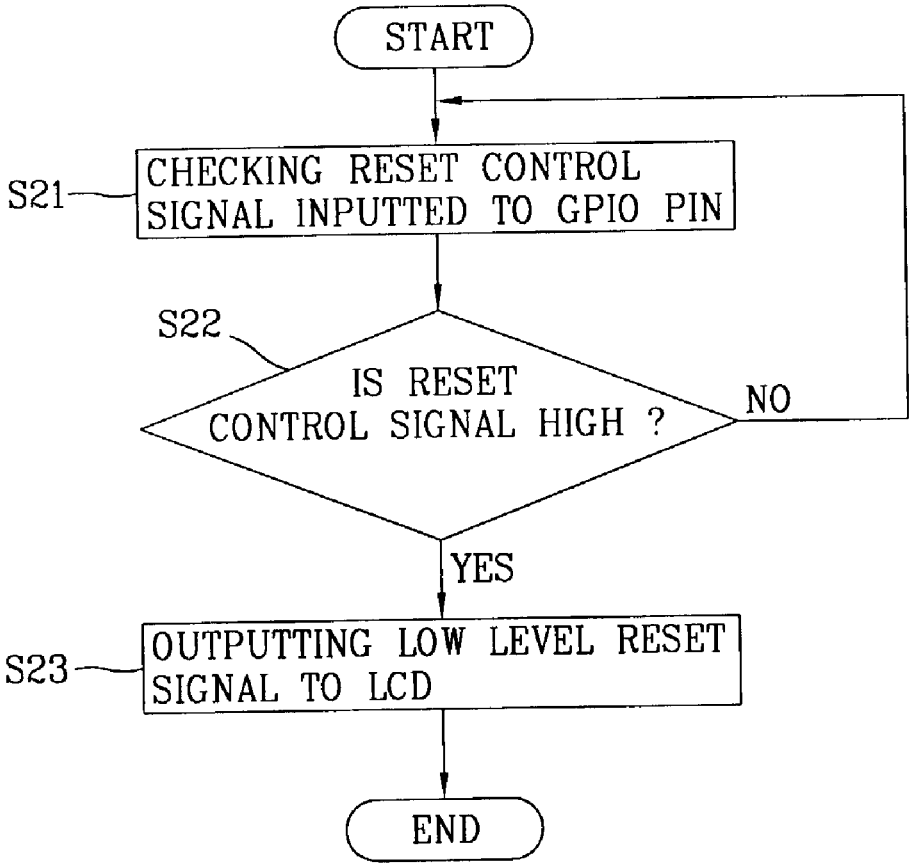
FIG. 3B is a flowchart of control routine used by the baseband chip set of FIG. 1, in accordance with one preferred embodiment of the present invention.

FIG. 3A is a flowchart of a control routine for the ESD detecting unit 200, in accordance with one preferred embodiment of the present invention, and FIG. 3B is a flowchart of control routine for the baseband chip set 300, in accordance with one preferred embodiment of the present invention.

When an ESD is applied to the LCD 100 of the mobile terminal, the voltages at each pin of the LCD 100 are instantly changed. In the embodiment of FIG. 2, the voltage at the VR pin (brightness control pin) exhibits the greatest voltage level change as a result of the ESD.

For example, if the voltage of the VR pin is maintained at about 0.9 V in a state in which no ESD has been applied thereto (i.e., in a normal state), when ESD is applied to the VR pin, the VR pin has a voltage level that falls below approximately 0.4 V or above approximately 1.5 V.

The voltage on the VR pin is a voltage obtained by a voltage input to the VS pin (a boosting voltage pin) of the LCD 100, which is distributed by voltage distribution resistances (R1, R2), and the brightness of the LCD 100 is controlled by a voltage (brightness control voltage) input to the VR pin.

The analog-digital converter 210 converts the analog voltage on the VR pin, which exhibits the greatest voltage level change when ESD occurs, into a digital voltage (Vrd) at step S11. Next, at step S12, the decision logic 220 checks whether the digital voltage (Vrd) output from the analog-digital converter 201 is within the predetermined range determined to be a normal state in which no ESD has been applied to the LCD 100.

If the digital voltage (Vrd) is within the predetermined range, the decision logic 220 determines that the LCD 100 is in a normal state. However, if the digital voltage (Vrd) is not within the predetermined range, the decision logic 220 determines that ESD has been applied to the LCD 100.

For example, if the voltage on the VR pin is approximately 0.9 V in a state in which no ESD has been applied to the LCD 100, the decision logic 220 sets a minimum threshold value (Thmin) of 0.4 V and a maximum threshold value (Thmax) of 1.5V for determining whether ESD has been applied to the LCD 100.

At steps S13 and S15, if the digital voltage (Vrd) is greater than 0.4V and smaller than 1.5 V, the decision logic 220 determines that no ESD has been applied to the LCD and outputs a low level reset control signal to the baseband chip set 300.

However, if the digital voltage (Vrd) is not greater than 0.4 V and not smaller than 1.5 V, the decision logic 220 determines that ESD has been applied to the LCD 100, and outputs a high level reset control signal to the baseband chip set 300, as shown in step S14.

Referring to FIG. 3B, the baseband chip set 300 checks a reset control signal input from the decision logic 220 through a global port for input/output (GPIO) at step S21. Then, at step S22, if the reset control signal is a low level reset control signal, the baseband chip set 300 determines that the LCD 100 is in a normal state. However, if the reset control signal is a high level reset control signal, the baseband chip set 300 determines that the LCD 100 is not in a normal state and outputs a high level reset signal to a reset pin (/RES pin) of the LCD 100 at step S23. Upon receiving the high level reset signal, the LCD 100 is reset and, thus, lock-up of the LCD 100 due to the occurrence of ESD is prevented.

In this manner, in the apparatus for preventing lock-up of an LCD in a mobile terminal, the voltage on the VR pin of the LCD is monitored to check whether ESD has been applied to the LCD.

As so far described, the apparatus and method of the present invention for preventing lock-up of an LCD in a mobile terminal have many advantages. For example, since a voltage on a specific pin of an LCD of a mobile terminal is monitored to detect whether ESD has been applied to the LCD, the LCD is reset only when ESD has been applied thereto. Because the LCD is not periodically reset, periodic blinking of the LCD is avoided.

Moreover, it is not necessary to install a plurality of TVS diodes in order to limit a voltage input to each pin of the LCD.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structure described herein as performing the recited function and not only structural equivalents but also equivalent structures.

What is claimed is:

1. An apparatus for preventing lock-up of a liquid crystal display (LCD), comprising:

the LCD;

an electrostatic discharge (ESD) detecting unit for detecting whether an ESD has been applied to the LCD by monitoring a single predetermined pin of the LCD that exhibits a voltage level change that is greater than a voltage level change exhibited by all other individual pins of the LCD when an ESD is applied to the LCD; and a baseband chip set for resetting the LCD according to a reset control signal output from the ESD detecting unit.

2. The apparatus of claim 1, wherein the ESD detecting unit comprises:

an analog-digital converter for converting an analog voltage input to a predetermined pin of the LCD into a digital voltage; and a decision logic for checking whether the digital voltage is within a predetermined range and determining whether an ESD has been applied to the LCD based on said determination.

3. The apparatus of claim 2, wherein the predetermined range is a voltage level range that a voltage on the predetermined pin falls within a normal state in which no ESD has been applied to the LCD.

4. The apparatus of claim 1, wherein the single predetermined pin is a brightness control pin.

5. An apparatus for preventing lock-up of a liquid crystal display (LCD), comprising:

an electrostatic discharge (ESD) detecting unit for monitoring a voltage input to a single predetermined pin of the LCD and detecting whether an ESD has been applied to the LCD based on the monitored voltage, wherein, when an ESD is applied to the LCD, the single predetermined pin exhibits a voltage level change that is greater than a voltage level change exhibited by all other individual pins of the LCD; and a baseband chip set for resetting the LCD according to a reset control signal output from the ESD detecting unit.

6. The apparatus of claim 5, wherein the ESD detecting unit comprises:

an analog-digital converter for converting the voltage input to the predetermined pin into a digital voltage; and a decision logic for checking whether the digital voltage is within a predetermined range in which the LCD is in a normal state and determining that an ESD has been applied to the LCD when the digital voltage falls outside the predetermined range.

7. The apparatus of claim 5, wherein the single predetermined pin is a brightness control pin.

8. An apparatus for preventing lock-up of a liquid crystal display (LCD) comprising:

the LCD;

an analog-digital converter for converting an analog voltage input to a single predetermined pin of the LCD into a digital voltage, wherein, when electrostatic discharge (ESD) is applied to the LCD, the single predetermined pin exhibits a voltage level change that is greater than a voltage level change exhibited by all other individual pins of the LCD;

a decision logic for determining whether an ESD has been applied to the LCD, by checking whether the digital voltage is within a predetermined range in which the LCD is in a normal state; and a baseband chip set for resetting the LCD under the control of the decision logic.

9. The apparatus of claim 8, wherein the single predetermined pin is a brightness control pin.

10. A method for preventing lock-up of a liquid crystal display (LCD), comprising:

converting an analog voltage of a single predetermined pin of the LCD into a digital voltage;

checking whether an electrostatic discharge (ESD) has been applied to the LCD based on the digital voltage; and resetting the LCD if an ESD has been applied to the LCD, wherein the single predetermined pin exhibits a voltage level change, in response to an ESD, that is greater than a voltage level change exhibited by all other individual pins of the LCD.

11. The method of claim 10, wherein checking whether an ESD has been applied to the LCD comprises:

checking whether the digital voltage is within the predetermined range; and determining that no ESD has been applied to the LCD if the digital voltage is within the predetermined range, and determining that an ESD has been applied to the LCD if the digital voltage is not within the predetermined range.

12. The method of claim 11, wherein the predetermined range is a voltage level range that a voltage on the predetermined pin falls within in a state in which no ESD has been applied to the LCD.

13. A method for preventing lock-up of a liquid crystal display (LCD), comprising:

monitoring a voltage on a single pin of the LCD;

determining if an electrostatic discharge (ESD) has been applied to the LCD based on the monitored voltage; and resetting the LCD if an ESD has been applied to the LCD, wherein the single pin whose voltage is monitored exhibits a voltage level change, in response to an ESD, that is greater than a voltage level change exhibited by all other individual pins of the LCD.

14. The method of claim 13, wherein it is determined whether an ESD has been applied to the LCD based on whether the monitored voltage falls within a predetermined range.

15. The method of claim 14, wherein it is determined that an ESD has been applied to the LCD if the monitored voltage falls outside the predetermined range.

16. An apparatus for preventing lock-up of a liquid crystal display (LCD), comprising:

the LCD;

an electrostatic discharge (ESD) detecting unit for monitoring only one pin among a plurality of pins of the LCD to detect whether an ESD has been applied to the LCD; and a baseband chip set for resetting the LCD according to a reset control signal output from the ESD detecting unit, wherein the only one pin is a predetermined pin of the LCD that exhibits a voltage level change that is greater than a voltage level change exhibited by all other individual pins of the LCD when an ESD is applied to the LCD.

17. The apparatus of claim 16, wherein the ESD detecting unit comprises:

an analog-digital converter for converting an analog voltage input to the predetermined pin of the LCD into a digital voltage; and a decision logic for checking whether the digital voltage is within a predetermined range and determining whether an ESD has been applied to the LCD based on said determination.

18. The apparatus of claim 17, wherein the predetermined range is a voltage level range that a voltage on the predetermined pin falls within a normal state in which no ESD has been applied to the LCD.

19. The apparatus of claim 16, wherein the one pin is a brightness control pin.

* * * * *